US008756897B1

(12) United States Patent
Kelley

(10) Patent No.: US 8,756,897 B1
(45) Date of Patent: Jun. 24, 2014

(54) COST EFFECTIVE METHOD FOR MANUFACTURING RETAINERS AND INSERTS INCORPORATED INTO A GARAGE DOOR PANEL

(71) Applicant: Robert A. Kelley, Orange, CA (US)

(72) Inventor: Robert A. Kelley, Orange, CA (US)

( * ) Notice: Subject to any disclaimer, the term of this patent is extended or adjusted under 35 U.S.C. 154(b) by 0 days.

(21) Appl. No.: 13/855,663

(22) Filed: Apr. 2, 2013

(51) Int. Cl.
*E06B 3/00* (2006.01)

(52) U.S. Cl.
USPC ..... 52/745.15; 52/309.4; 52/458

(58) Field of Classification Search
USPC ..... 52/171.3, 204.53–204.591, 309.4, 52/455–458, 210–217, 309.15, 745.15, 52/745.19, 745.05, 204.61, 204.71; 49/197
See application file for complete search history.

(56) References Cited

U.S. PATENT DOCUMENTS

| | | | | | |
|---|---|---|---|---|---|
| 2,183,519 | A * | 12/1939 | Rose | 160/183 |
| 3,028,786 | A * | 4/1962 | Wanielista et al. | 355/73 |
| 3,912,542 | A * | 10/1975 | Hirano et al. | 156/104 |
| 4,314,598 | A * | 2/1982 | Roesch | 160/90 |
| 4,875,317 | A * | 10/1989 | Logan et al. | 52/208 |
| 5,563,682 | A * | 10/1996 | Aikawa et al. | 355/53 |
| 5,715,636 | A * | 2/1998 | Taylor | 52/308 |
| 5,894,706 | A * | 4/1999 | Herbst | 52/782.1 |
| 5,910,083 | A * | 6/1999 | Richardson et al. | 52/171.1 |
| 6,590,320 | B1 * | 7/2003 | Abanshin et al. | 313/309 |
| 6,625,941 | B2 * | 9/2003 | Shaw | 52/211 |
| 6,722,083 | B2 * | 4/2004 | Herrmann et al. | 49/501 |
| 8,359,796 | B1 * | 1/2013 | Plummer et al. | 52/204.61 |
| 2009/0241422 | A1 * | 10/2009 | Mock et al. | 49/197 |
| 2011/0296771 | A1 * | 12/2011 | Miller et al. | 52/171.3 |

* cited by examiner

*Primary Examiner* — Jeanette E. Chapman
(74) *Attorney, Agent, or Firm* — Thomas I. Rozsa

(57) ABSTRACT

A method for forming garage door components, the method including: (a) vacuum forming a combination of a retainer combined with the formation of a decorative insert vacuum formed within the retainer, the decorative insert removed from the retainer to provide a separate retainer and a separate decorative insert, by forming them together, the interior of the vacuum formed piece is used as the decorative insert instead of being thrown away as in prior art vacuum forming processes thereby saving wasting the interior vacuum formed material. There is also a garage door panel including an interior retainer retaining a glass plate on its rear surface, and inserted into an opening in a garage door panel and a window frame inserted into the garage door panel on its opposite side to retain the glass plate by its front surface. A decorative insert is retained between the glass plate and the window frame.

10 Claims, 16 Drawing Sheets

COST EFFECTIVE METHOD FOR MANUFACTURING RETAINERS AND INSERTS INCORPORATED INTO A GARAGE DOOR PANEL

BACKGROUND OF THE INVENTION

1. Field of the Invention

The present invention relates to the field of garage doors and in particular to garage door frames and retainers which retain a glass panel between them and to decorative inserts affixed to the front of the retainer and in front of the glass panel to provide an aesthetic appearance to the garage door.

2. Description of the Prior Art

In the prior art, the plastic retainer is formed a by a vacuum formed process and the retainer is cut out from the final product. The interior of the retainer and the exterior circumference of the retainer are discarded, resulting in a lot of wasted material. The decorative inserts are also separately vacuum formed in a separate process and excess material is cut away, resulting in even more waste of material.

There is a significant need for a more cost effective way to produce the retainer and decorative insert to create a complete garage door panel.

SUMMARY OF THE INVENTION

The present invention is a method for forming garage door components, the method including: (a) vacuum forming a combination of a retainer combined with the formation of a decorative insert vacuum formed within the retainer, the decorative insert removed from the retainer to provide a separate retainer and a separate decorative insert, by forming them together, the interior of the vacuum formed piece is used as the decorative insert instead of being thrown away as in prior art vacuum forming processes thereby saving wasting the interior vacuum formed material; (b) the separate retainer is cut to include an elevated sidewall including parallel first and second lengthwise sidewalls and parallel first and second transverse walls and an interior recessed shelf with surfaces which correspond to the walls of the elevated sidewall, including a first lengthwise surface is aligned with the first lengthwise sidewall, a second lengthwise surface is aligned with the second lengthwise sidewall, a first transverse surface aligned with first transverse wall, a second transverse surface aligned with second transverse wall; (c) the interior recessed shelf is formed of sufficient thickness to pass through a garage door panel having a rear wall and interior foam of the given thickness; (d) there is further formed a multiplicity of stiffening ribs including parallel transverse ribs respectively center positioned to support first transverse surface and first transverse wall, and second transverse surface and second transverse wall, at least one stiffening rib to support first lengthwise surface and first lengthwise sidewall, and at least one stiffening rib to support second lengthwise surface and second lengthwise sidewall; (e) the interior recessed shelf is formed with four respective interior surfaces which correspond with a respective first lengthwise surface, first transverse surface, second lengthwise surface and second transverse surface; (f) adjacent the rear surfaces of interior recessed shelf is formed with an interior protruding shelf with protruding first and second lengthwise surface and first and second width-wise surfaces; and (g) a decorative insert is cut away from the interior of the retainer, the decorative insert has an exterior sidewall with parallel first and second lengthwise walls and first and second parallel transverse walls with n central interior lengthwise wall and at least one interior transverse wall which divide the decorative insert into a multiplicity of separate openings through which glass is visible.

Described more broadly, the present invention is a method for forming garage door components, the method including: (a) vacuum forming a combination of a retainer combined with the formation of a decorative insert vacuum formed within the retainer, the decorative insert removed from the retainer to provide a separate retainer and a separate decorative insert, by forming them together the interior of the vacuum formed piece is used as the decorative insert instead of being thrown away as in prior art vacuum forming processes thereby saving wasting the interior vacuum formed material; (b) the separate retainer is cut to include an elevated sidewall including parallel first and second lengthwise sidewalls and parallel first and second transverse walls and an interior recessed shelf with surfaces which correspond to the walls of the elevated sidewall, including a first lengthwise surface is aligned with the first lengthwise sidewall, a second lengthwise surface is aligned with the second lengthwise sidewall, a first transverse surface aligned with first transverse wall, a second transverse surface aligned with second transverse wall; (c) the interior recessed shelf is formed with four respective interior surfaces which correspond with a respective first lengthwise surface, first transverse surface, second lengthwise surface and second transverse surface; (d) adjacent the rear surfaces of interior recessed shelf is formed with an interior protruding shelf with protruding first and second lengthwise surfaces and first and second width-wise surfaces; and (e) a decorative insert is cut away from the interior of the retainer, the decorative insert has an exterior sidewall with parallel first and second lengthwise walls and first and second parallel transverse walls with a central interior lengthwise wall and at least one interior transverse walls which divide the decorative insert into a multiplicity of separate openings through which glass is visible.

In the first method described above, the retainer is used for garage door panels which are thicker because they have foam inside the garage door panel, which makes them stronger for a thicker recessed shelf which extends through a thick garage door interior. In the second method described above, the retainer is thinner because it does not need the stiffening ribs and is used with a garage door panel which is thinner because it has no insulation within the garage door panel. In the second method described above, to be used for a garage door panel with insulation, the method would further include (a) the interior recessed shelf of the retained is formed of sufficient thickness to pass through a garage door panel having a rear wall and interior foam of the given thickness; and (b) there is further formed in the retainer a multiplicity of stiffening ribs including parallel transverse ribs respectively center positioned to support first transverse surface and first transverse wall, and second transverse surface and second transverse wall, at least one stiffening rib to support first lengthwise surface and first lengthwise sidewall, and at least one stiffening rib to support second lengthwise surface and second lengthwise sidewall.

The present invention also is components for a garage door panel, including: (a) a garage door panel including a first wall, a second parallel wall, a third wall and a fourth parallel wall, the walls having a given thickness and a common front surface and a common rear surface, the walls surrounding a recessed shelf with four surfaces with two adjacent surfaces being perpendicular to each other and which are respectively aligned with a respective wall of the garage door panel, the recessed shelf and the four walls of the garage door panel surrounding an interior opening; (b) a window frame having four walls with two adjacent walls being perpendicular to each other and having a common front surface and a common rear surface, the window frame having a recessed surface having four surfaces which are respectively aligned with a respective window frame wall, the window frame inserted into the opening in the garage door panel so that the four recessed surfaces respectively fit within the opening and respectively rest adjacent recessed surfaces of the recessed shelf of the garage door panel, and the common rear surface of the frame walls respectively rest on the recessed surfaces of the shelf of the window frame and also respectively rest adjacent the garage door panel walls, the recessed surfaces respectively have recessed rear surfaces; © a glass plate has a front surface which is press fit against common rear surfaces of the recessed shelf of the window frame, the glass plate having a rear surface; (d) a separate retainer including an elevated sidewall including parallel first and second lengthwise sidewalls and parallel first and second transverse walls and an interior recessed shelf with surfaces which correspond to the walls of the elevated sidewall, including a first lengthwise surface is aligned with the first lengthwise sidewall, a second lengthwise surface is aligned with the second lengthwise sidewall, a first transverse surface aligned with first transverse wall, a second transverse surface aligned with second transverse wall; (e) the interior recessed shelf is formed with four respective interior surfaces which correspond with a respective first lengthwise surface, first transverse surface, second lengthwise surface and second transverse surface; (f) adjacent the rear surfaces of interior recessed shelf is formed with an interior protruding shelf with protruding first and second lengthwise surface and first and second width-wise surfaces; (g) a decorative insert has an exterior sidewall with parallel first and second lengthwise walls and first and second parallel transverse walls with a central interior lengthwise wall and at least one interior transverse wall which divides the decorative insert into a multiplicity of separate openings through which the glass plate is visible; (h) the retainer is inserted from the rear of the door panel so that protruding rear surfaces of protruding interior shelf are pressed against the rear surface of the glass plate and therefore, the glass plate is trapped and retained between the protruding rear surfaces of interior protruding shelf and just below a screw line of the rear surfaces of the interior recessed shelf and the common rear surfaces of the recessed shelf; and a multiplicity of fastening screws are screwed through interior recessed shelf and its surfaces and through corresponding rear surfaces and screwed into the common rear surfaces of frame walls so that the fastening members are not visible from common front surface of the frame walls; and (j) the decorative insert is inserted into a small gap between the glass plate and the recessed surfaces of the frame through edges of the decorative insert so that the glass plate is visible through decorative insert openings.

The above garage door panel is thin because it has no insulation. If the garage door panel has insulation, the retainer would have to be thick to accommodate the extra thickness the foam adds to the garage door panel. In that case, the components of the garage door panel would also include: (a) the interior recessed shelf is formed of sufficient thickness to pass through a garage door panel having a rear wall and interior foam of the given thickness; and (b) there is further formed a multiplicity of stiffening ribs including parallel transverse ribs respectively center positioned to support first transverse surface and first transverse wall, and second transverse surface and second transverse wall, at least one stiffening rib to support first lengthwise surface and first lengthwise sidewall, and at least one stiffening rib to support the second lengthwise surface and second lengthwise sidewall.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
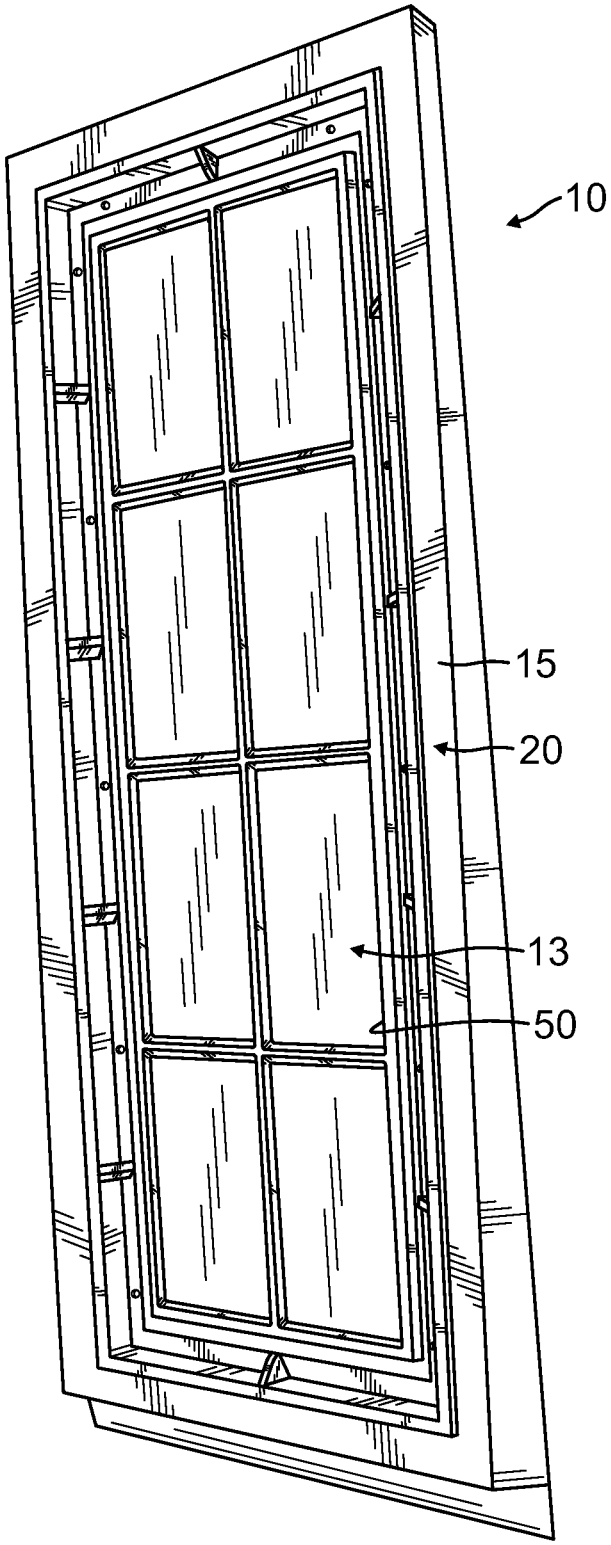
FIG. 1 is a front perspective view of the completed vacuum formed combination of the present invention insulated retainer and decorative insert for a long panel garage door window section.
Figure 2:
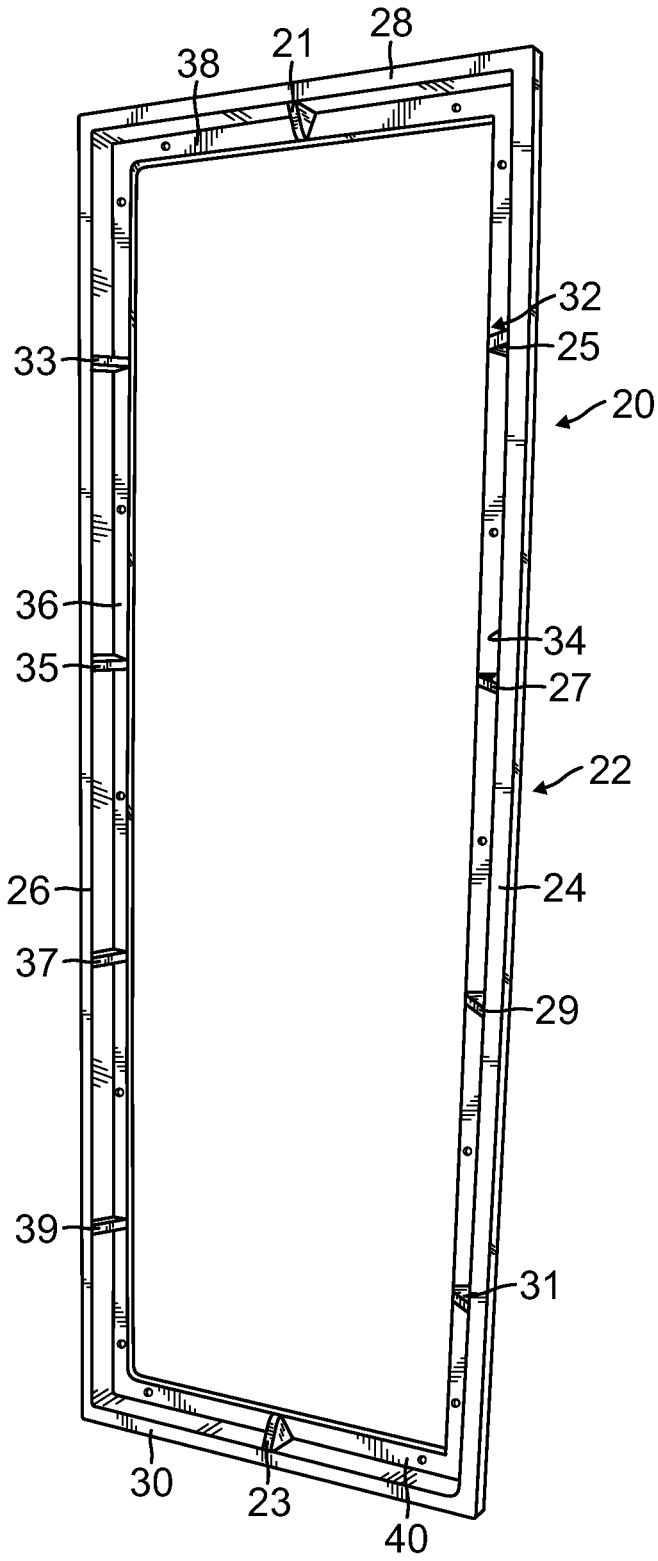
FIG. 2 is a front perspective view of the cut out vacuum formed insulated retainer cut from the competed vacuum formed insulated retainer and decorative insert illustrated in FIG. 1.
Figure 8A:
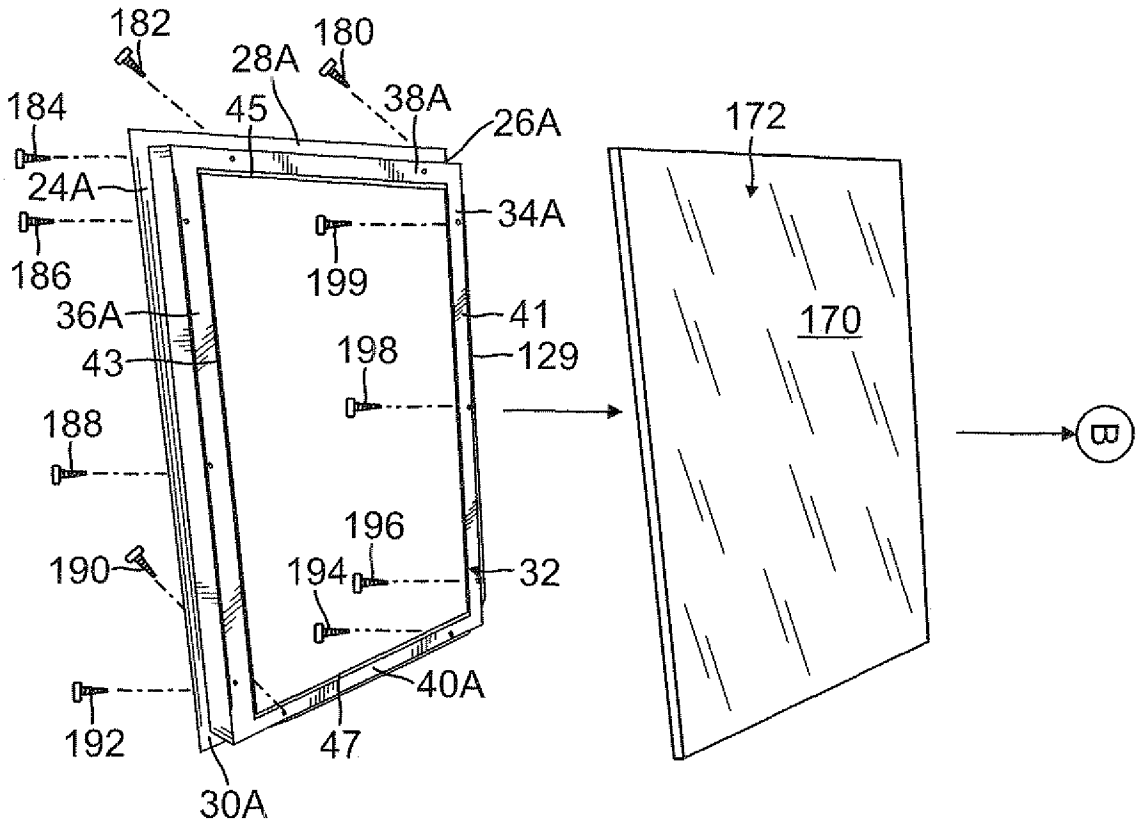
FIG. 8A is a front exploded view of a portion of the improved cost effective garage door window assembly incorporating the present invention which includes the insulated retainer and a plate of glass.
Figure 8B:
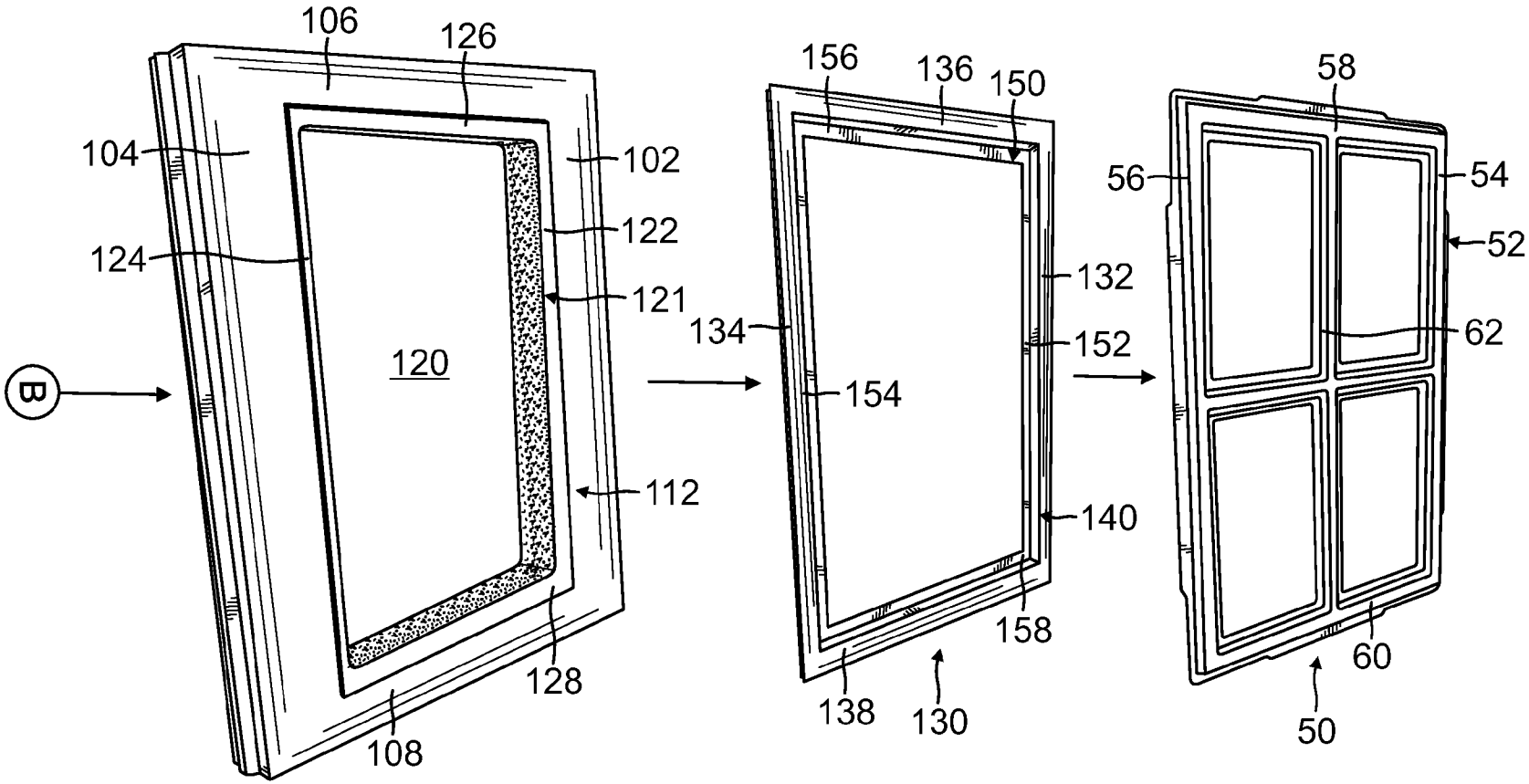
FIG. 8B is a continuation of FIG. 8A and is a front exploded view of the improved cost effective garage door window assembly incorporating the present invention which includes the sample panel size garage door section, the front window frame and the decorative insert.

Referring to FIG. 1 through 4, a component of the present invention is the method of vacuum forming the combination 10 of a retainer 20, whether insulated or non-insulated combined with the formation of the decorative insert 50. The combination 10 vacuum formed retainer 20 and decorative insert 50 is illustrated in FIG. 1. The retainer 20 is formed by vacuum forming. In the prior art, the interior plastic vacuum formed piece 13 where the decorative insert 50 is located is a blank piece of plastic which is cut away from the retainer 20. The exterior vacuum formed section 15 is also discarded. The retainer 20 as illustrated in FIG. 2 remains. Also referring to FIG. 8A, the retainer 20 has an elevated sidewall 22 including parallel lengthwise walls 24 and 26 and parallel transverse walls 28 and 30 with respective interior surfaces 24A, 26A, 28A and 30A. The retainer 20 has an interior recessed shelf 32 with surfaces which correspond to the walls of the elevated sidewall 22. Lengthwise surface 34 is aligned with lengthwise sidewall 24. Lengthwise surface 36 is aligned with lengthwise sidewall 26. The interior recessed shelf 32 is of sufficient thickness to accommodate the garage door insulation. Transverse surface 38 is aligned with transverse wall 28. Transverse surface 40 is aligned with transverse wall 30. A multiplicity of stiffening ribs including parallel transverse ribs 21 and 23 are respectively center positioned to support transverse surface 38 and transverse wall 28, and transverse surface 30 and transverse wall 40. Four spaced apart stiffening ribs 25, 27, 29 and 31 support lengthwise surface 34 and lengthwise sidewall 24. Four spaced apart stiffening ribs 33, 35, 37 and 39 support lengthwise surface 36 and lengthwise sidewall 26. Interior recessed shelf 32 has four respective interior surfaces 34A, 36A, 38A and 40A respective corresponding surfaces 34, 36, 38 and 40. Adjacent rear surface 34A, 36, 38A and 40A of interior recessed shelf 32 is a small interior protruding shelf 42 with protruding rear surfaces 41, 43, 45 and 47.

Figure 3:
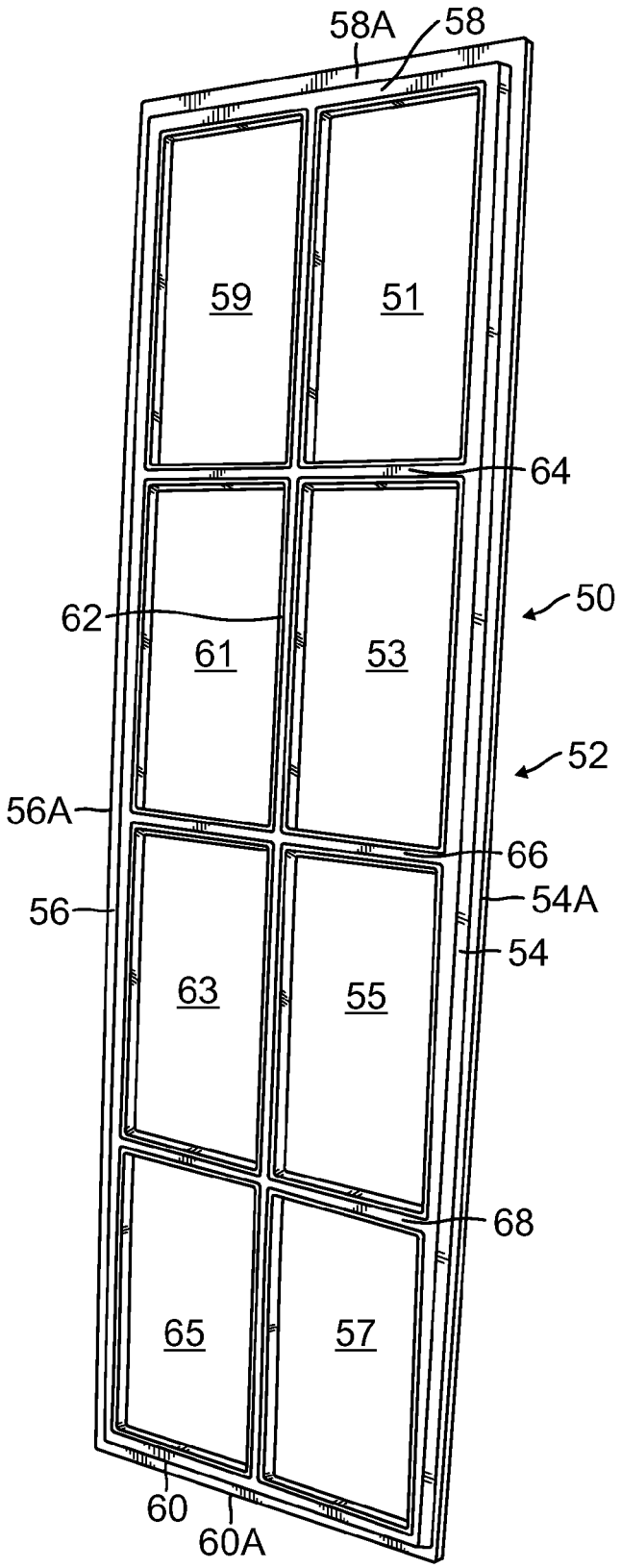
FIG. 3 is a front perspective view of the cut out vacuum formed decorative insert cut from the competed vacuum formed insulated retainer and decorative insert illustrated in FIG. 1.
Figure 4:
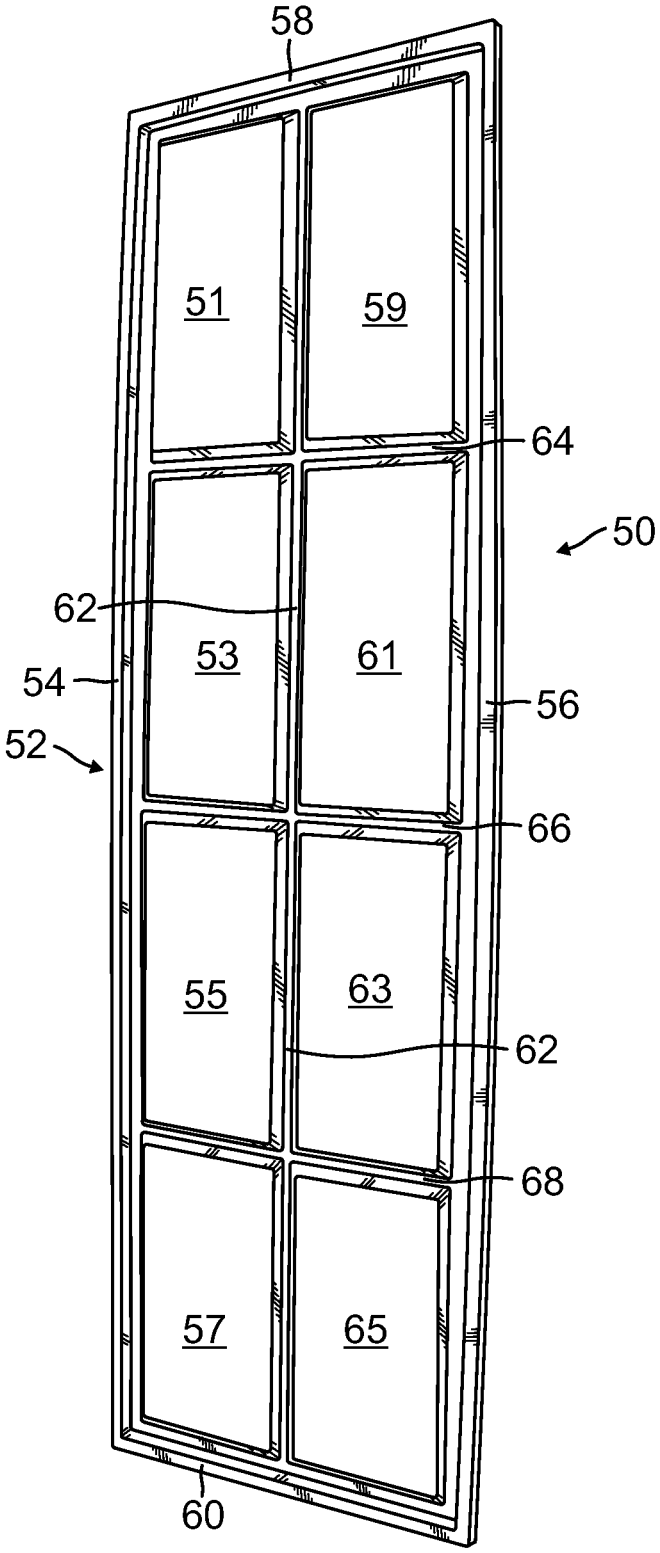
FIG. 4 is a rear perspective view of the cut out vacuum formed decorative insert cut from the competed vacuum formed insulated retainer and decorative insert illustrated in FIG. 1.

A key innovation of the present invention is to form the decorative insert 50 as illustrated in FIG. 1 in place of the discarded plastic section 22. The decorative insert 50 is cut away from the retainer 20 and is illustrated in FIGS. 3 and 4. As a result, there is a significant cost saving of plastic material because the plastic interior 12 which in the past was discardedis instead formed into the decorative insert 50. The decorative inset 50 has an exterior sidewall 52 with parallel lengthwise walls 54 and 56 and parallel transverse walls 58 and 60, with a central interior lengthwise wall 62 and three evenly spaced apart interior transverse walls 64, 66 and 68 which divide the decorative insert 50 into eight (8) separate openings 51, 53, 55, 57, 59, 61, 63 and 65, through which glass is visible.

A shorter four (4) panel section is illustrated in FIGS. 5 through 8B. The garage door panel 100 has a first wall 102, a second parallel wall 104, a third wall 106 and a fourth parallel wall 108, the walls having a given thickness to retain insulating foam 110 (see FIG. 7B) and the walls surround a recessed shelf 121 with surfaces 122, 124, 126 and 128 which are respectively aligned with walls 102, 104, 106 and 108 with a common front surface 112 and common rear surface 114 and which surround an opening 120. The walls 102, 104, 106 and 108 have the common front surface 112 and a common rear surface 114.

A window frame 130 has four walls 132, 134, 136 and 138 with a common front surface 140 and a common rear surface 160. The frame has a recessed surface 150 with surfaces 152, 154, 156 and 158 which are respectively aligned with the four walls 132, 134, 136 and 138. The window frame 130 is inserted into opening 120 so that the four recessed surfaces 152, 154, 156 and 158 respectively fit within opening 120 and respectively rest adjacent recessed surfaces 122, 124, 126 and 128 of shelf 121 and frame walls common rear surface 160 of frame walls 132, 134, 136 and 138 respectively rest on recessed surfaces 122, 124, 126 and 128 and shelf 121, also respectively rest adjacent garage door panel walls 102, 104, 106 and 108. Recessed surfaces 152, 154, 156 and 158 have a given thickness to accommodate the insulation 110. Recessed surfaces 122, 124. 126 and 128 respectively have recessed rear surfaces 122A, 124A, 126A and 128A.

A glass plate 170 has a front surface 172 which is press fit against common rear surfaces 122A, 124A, 126A, and 128A of recessed shelf 121 and its surfaces 122, 124, 126 and 128 window frame 130. The glass plate has a rear surface 174. The retainer 20 is inserted from the rear of the door panel so that protruding rear surfaces 41, 43, 45 and 47 of protruding interior shelf are pressed against the rear surface 174 of the glass plate 170. Therefore, the glass plate 170 is trapped and retained between the protruding rear surfaces 41, 43, 45 and 46 of interior protruding shelf 42 and just below the screw line of rear surfaces 34A, 36A, 38A and 40A of interior recessed shelf 32 and the common rear surfaces 122A, 124A, 126A and 128A of recessed shelf 121.

Figure 5:
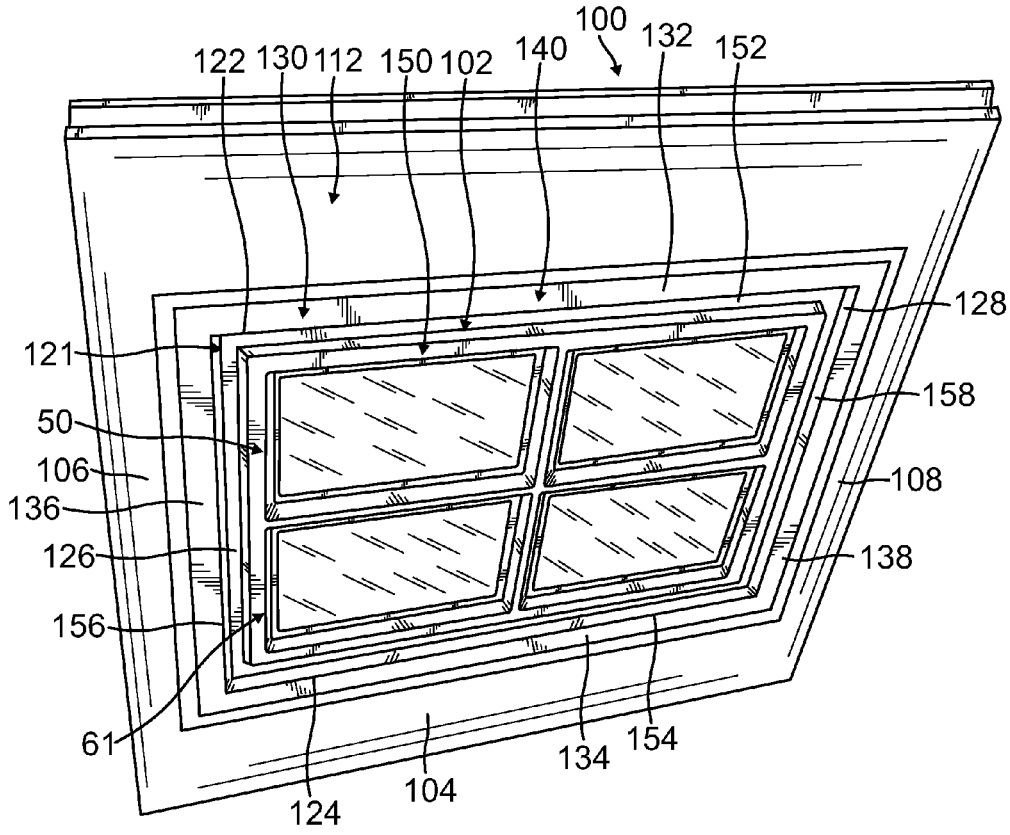
FIG. 5 is a front perspective view of a completed short panel door size garage door panel incorporating the present invention which includes the garage door, frame, insulated retainer, plate of glass and decorative insert.
Figure 6:
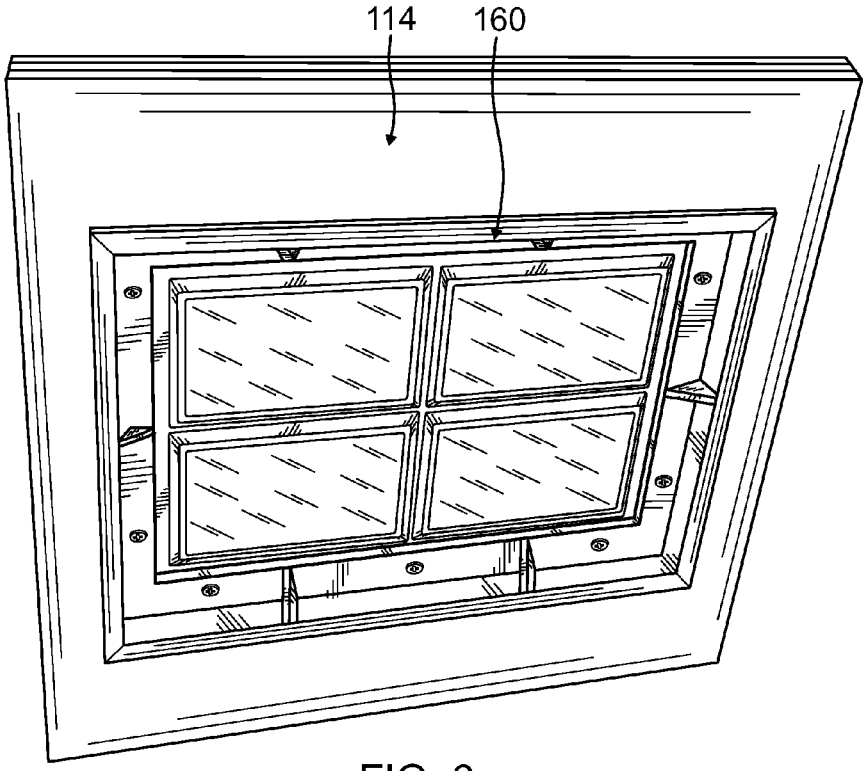
FIG. 6 is a rear perspective view of a completed short panel door size incorporating the present invention which includes the garage door, frame, insulated retainer, plate of glass and decorative insert.
Figure 7A:
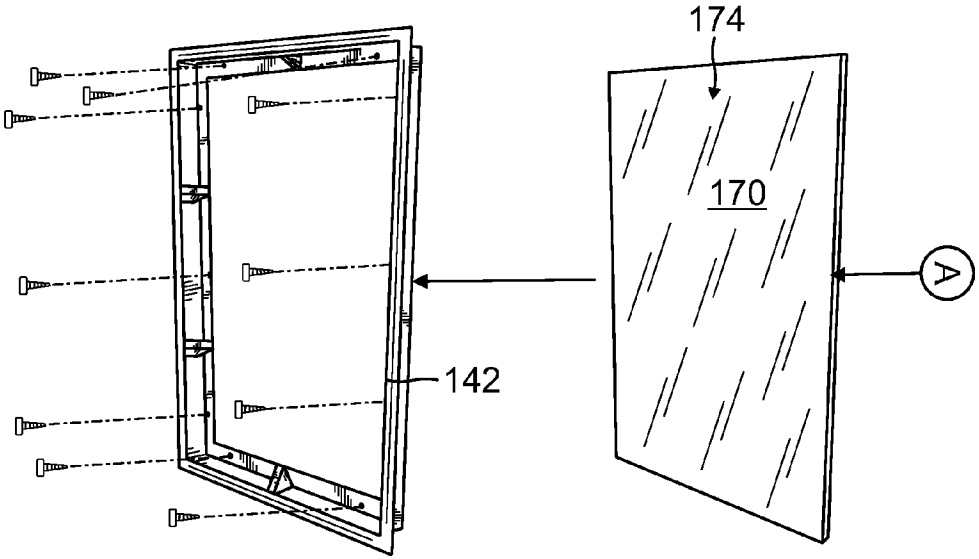
FIG. 7A is a rear exploded view of a portion of the improved cost effective garage door window assembly incorporating the present invention which includes the insulated retainer and a plate of glass.
Figure 7B:
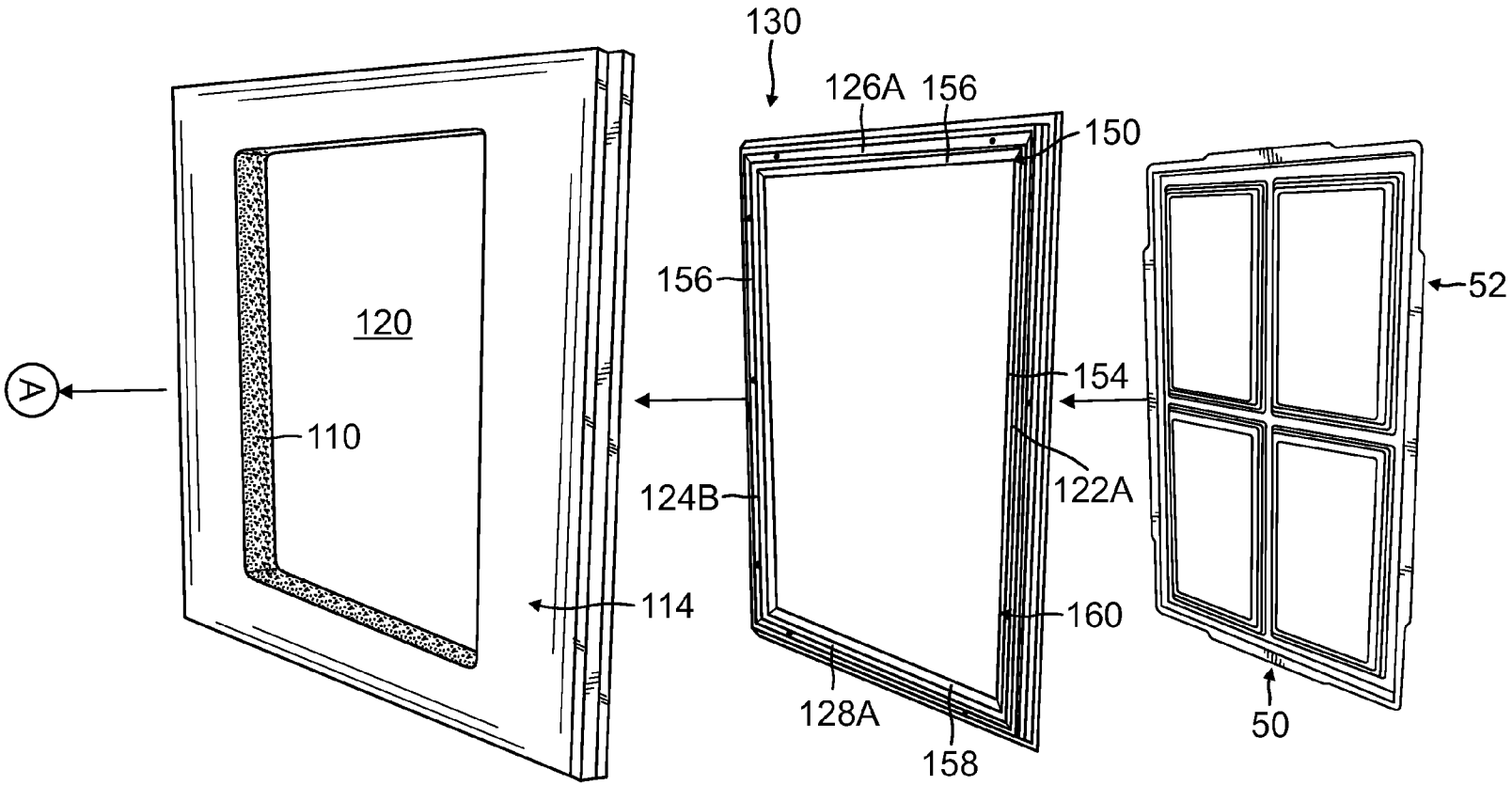
FIG. 7B is a continuation of FIG. 7A and is a rear exploded view of the improved cost effective garage door window assembly incorporating the present invention which includes the sample panel size garage door section, the front window frame and the decorative insert.

A multiplicity of fastening members such as screws 180, 182, 184, 186, 188, 190, 192, 194, 196, 198 and 199 are screwed through interior recessed shelf 32 through corresponding rear surfaces 34A, 36A, 38A and 40A and its corresponding front surfaces 34, 36, 38 and 40 and screwed into the common rear surfaces of 160 of frame walls 132, 134, 136 and 138 so that the fastening members are not visible from common front surface 140 of frame walls 132, 134, 136 and 138. Interior recessed shelf if of sufficient thickness to accommodate the insulation 110. The decorative insert 50 is inserted into a small gap "G1" between the glass plate 170 and recessed surfaces 152 154, 156 and 158 of frame 150 through the edges 54A, 56A, 58A and 60A of its sidewall 54, 56, 58 and 60 so that the glass plate 170 is visible through decorative insert openings. The completed assembly is illustrated in FIGS. 5 and 6.

Figure 9:
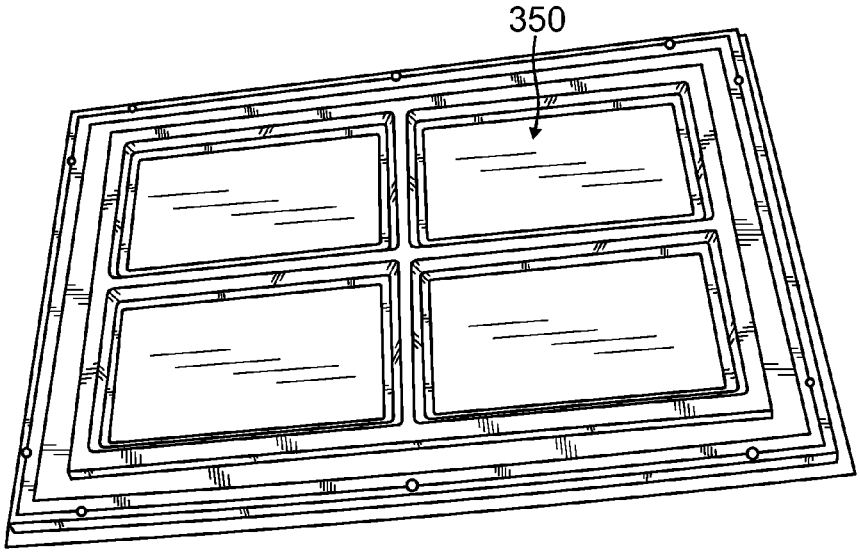
FIG. 9 is a front perspective view of the alternative embodiment of a formed part before cutting and separating the non-insulated retainer and decorative insert.
Figure 10:
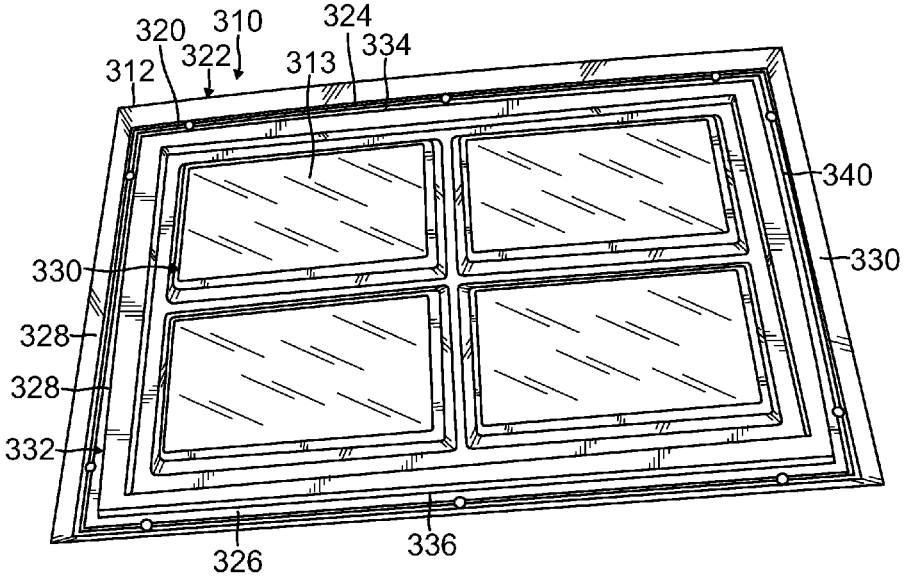
FIG. 10 is a rear perspective view of the alternative embodiment of a formed part before cutting and separating the non-insulated retainer and decorative insert.
Figure 11:
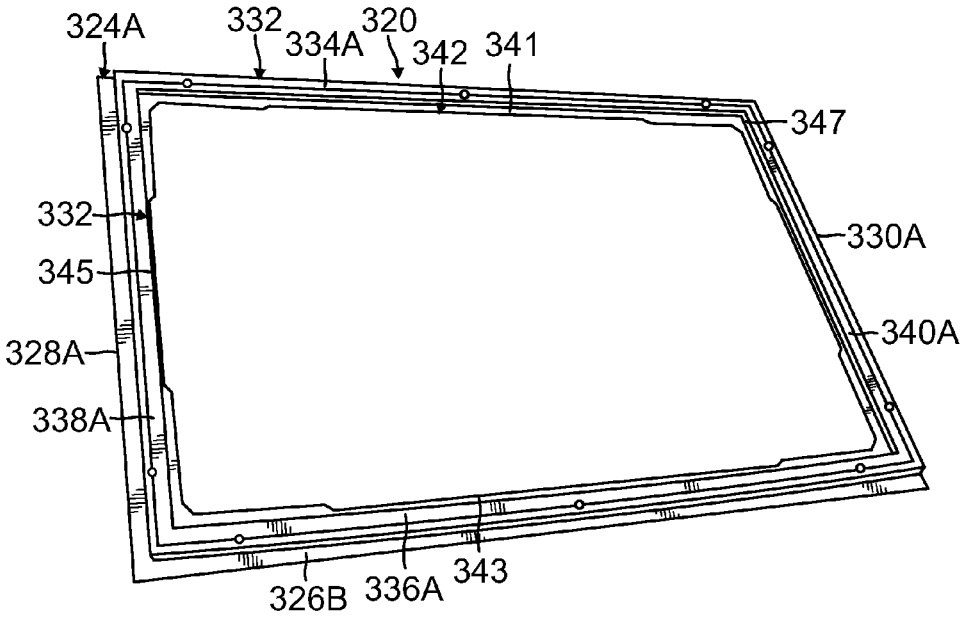
FIG. 11 is a front perspective view of a cut out vacuum formed non-insulated retainer.

FIGS. 9 through 12 illustrate the same embodiment but with a non-insulated retainer which is thinner since it does not have to accommodate any insulation thickness in a garage door. Referring to FIG. 9 through 12, a component of the present invention is the method of vacuum forming the combination 310 of a retainer 320, whether insulated or non-insulated combined with the formation of the decorative insert 350. The combination 310 vacuum formed retainer 320 and decorative insert 330 is illustrated in FIG. 10. The retainer 320 is formed by vacuum forming. In the prior art, the interior plastic vacuum formed piece 313 where the decorative insert 320 is located is a blank piece of plastic which is cut away from the retainer 320. The exterior vacuum formed section 315 is also discarded. The retainer 320 as illustrated in FIG. 11 remains. The retainer 320 has an elevated sidewall 322 including parallel lengthwise walls 324 and 326 and parallel transverse walls 328 and 330 with respective interior surfaces 324A, 326A, 328A and 330A. The retainer 320 has an interior recessed shelf 332 with surfaces which correspond to the walls of the elevated sidewall 322. Lengthwise surface 34 is aligned with lengthwise sidewall 324. Lengthwise surface 336 is aligned with lengthwise sidewall 326. The interior recessed shelf 332 is thinner than recessed shelf 32 since it does not require a certain sufficient thickness because there is no garage door insulation. Transverse surface 338 is aligned with transverse wall 328. Transverse surface 340 is aligned with transverse wall 330. Since it is thinner, the retainer 320 does not require the multiplicity of stiffening ribs found in the thicker retainer 20 which needed to be of sufficient thickness to accommodate the insulation of a garage door. Interior recessed shelf 332 has four respective interior surfaces 334A, 336A, 338A and 340A respective corresponding surfaces 334, 336, 338 and 340. Adjacent rear surface 334A, 336, 338A and 340A of interior recessed shelf 332 is a small interior protruding shelf 342 with protruding rear surfaces 341, 343, 345 and 347.

Figure 12:
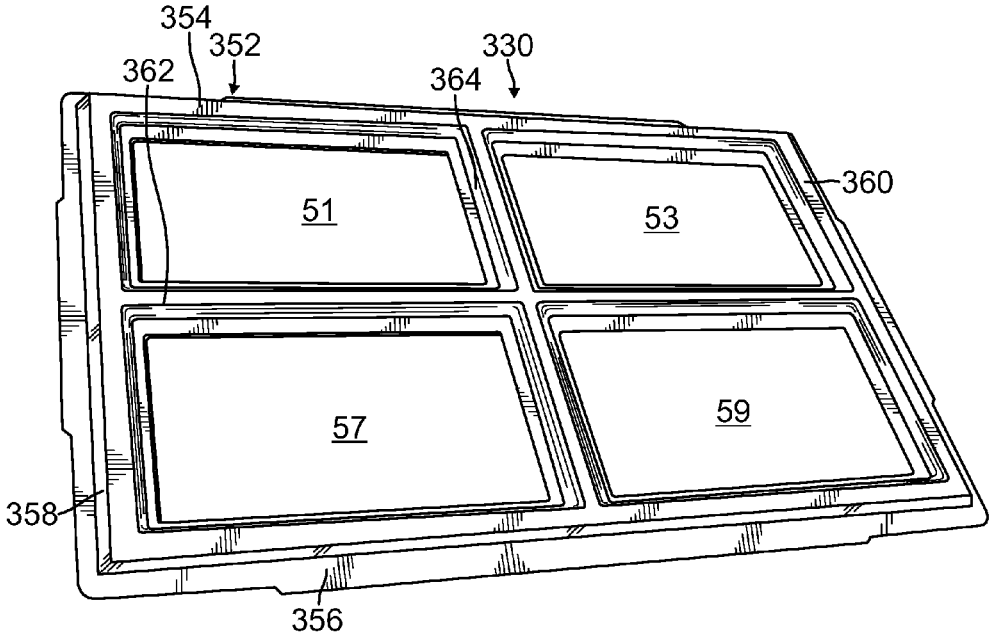
FIG. 12 is a front perspective view of a decorative insert to be used with a non-insulated or insulated retainer.
Figure 13:
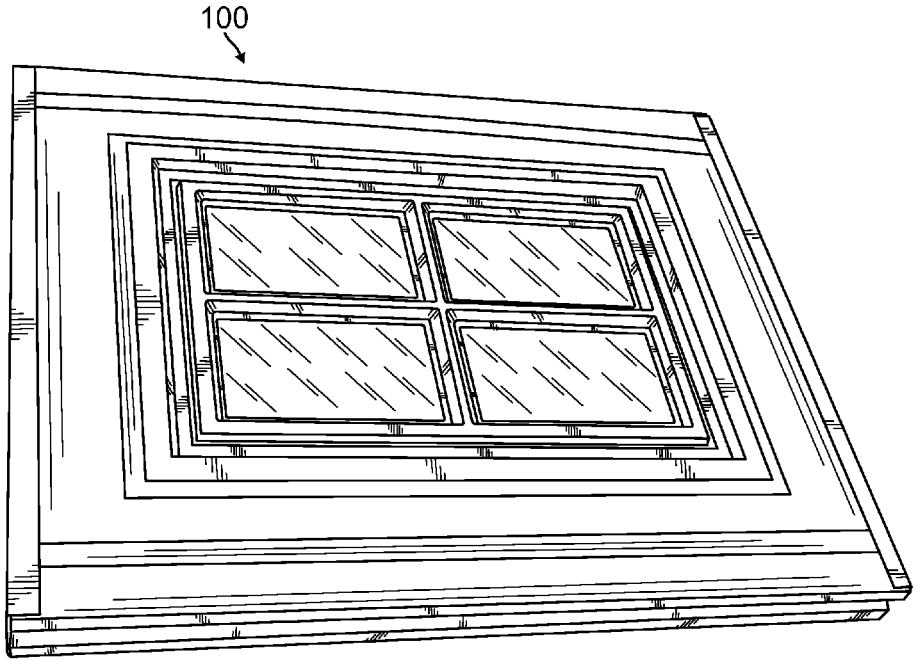
FIG. 13 is a front perspective view of an alternative embodiment of a completed sample panel size garage door section incorporating the present invention door section, front window frame, non-insulated retainer, plate of glass and decorative insert.
Figure 14:
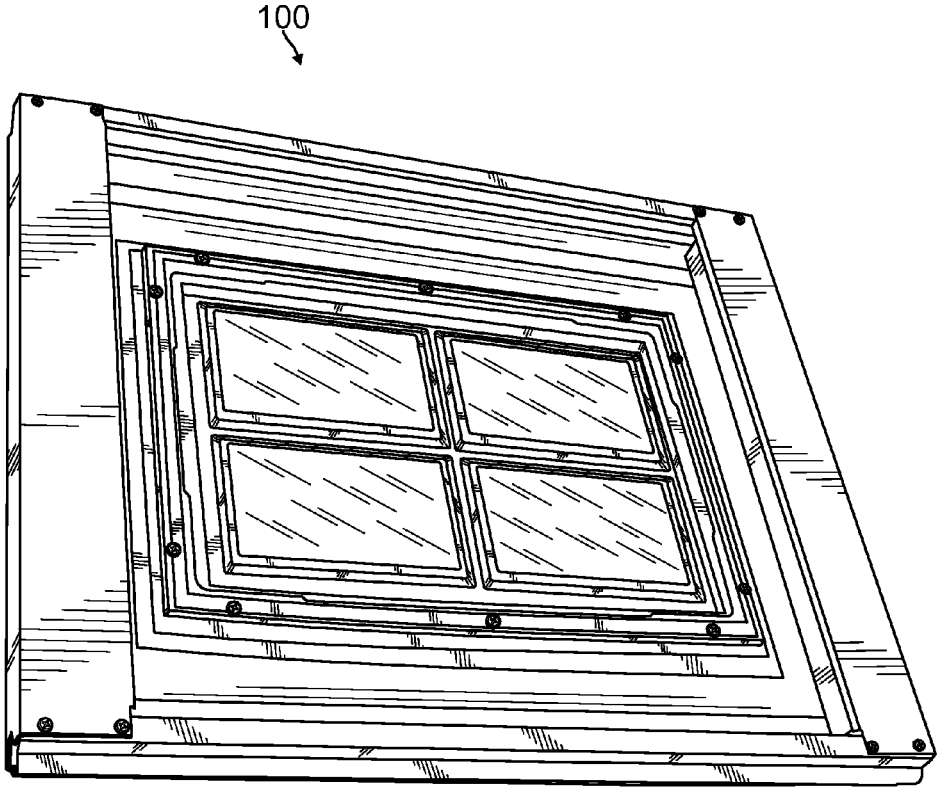
FIG. 14 is a rear perspective view of the alternative embodiment of a completed sample panel size garage door section incorporating the present invention door section, front window frame, non-insulated retainer, plate of glass and decorative insert.

A key innovation of the present invention is to form the decorative insert 350 as illustrated in FIG. 9 in place of the discarded plastic section. The decorative insert 350 is cut away from the retainer 320 and is illustrated in FIG. 12. As a result, there is a significant cost saving of plastic material because the plastic interior which in the past was discarded is instead formed into the decorative insert 350. The decorative inset 350 has an exterior sidewall 352 with parallel lengthwise walls 354 and 356 and parallel transverse walls 358 and 360, with n central interior lengthwise wall 362 and a central transverse wall 364 divides the decorative insert 350 into four (4)) separate openings 51, 53, 57, and 59, FIGS. 13 and 14 illustrate a completed garage door assembly comparable to FIGS. 5 and 6, the difference being a thinner garage door panel 100 which has no insulation and the retainer 320 is thinner. Otherwise, the configuration is assembled the same way with the same components to provide a similar appearance.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A method for forming garage door components, comprising:

a vacuum forming a combination of a retainer combined with the formation of a decorative insert vacuum formed within the retainer, the decorative insert removed from the retainer to provide a separate retainer and a separate decorative insert;

b. the separate retainer is cut to include an elevated sidewall including parallel first and second lengthwise sidewalls and parallel first and second transverse walls and an interior recessed shelf with surfaces which correspond to the walls of the elevated sidewall, including a first lengthwise surface is aligned with the first lengthwise sidewall, a second lengthwise surface is aligned with the second lengthwise sidewall, a first transverse surface aligned with first transverse wall, a second transverse surface aligned with second transverse wall;

c. the interior recessed shelf is formed of sufficient thickness to pass through a garage door panel having a rear wall and interior foam of the given thickness;

d. there is further formed a multiplicity of stiffening ribs including parallel transverse ribs respectively center positioned to support first transverse surface and first transverse wall, and second transverse surface and second transverse wall, at least one stiffening rib to support first lengthwise surface and first lengthwise sidewall, and at least one stiffening rib to support second lengthwise surface and second lengthwise sidewall;

e. the interior recessed shelf is formed with four respective interior surfaces which correspond with a respective first lengthwise surface, first transverse surface, second lengthwise surface and second transverse surface;

f. adjacent the rear surfaces of interior recessed shelf is formed with an interior protruding shelf with protruding first and second lengthwise surfaces and first and second width-wise surfaces; and g. a decorative insert is cut away from the interior of the retainer, the decorative insert has an exterior sidewall with parallel first and second lengthwise walls and first and second parallel transverse walls with a central interior lengthwise wall and at least one interior transverse wall which divide the decorative insert into a multiplicity of separate openings through which glass is visible.

2. A method for forming garage door components, comprising:

a vacuum forming a combination of a retainer combined with the formation of a decorative insert vacuum formed within the retainer, the decorative insert removed from the retainer to provide a separate retainer and a separate decorative insert;

b. the separate retainer is cut to include an elevated sidewall including parallel first and second lengthwise sidewalls and parallel first and second transverse walls and an interior recessed shelf with surfaces which correspond to the walls of the elevated sidewall, including a first lengthwise surface is aligned with the first lengthwise sidewall, a second lengthwise surface is aligned with the second lengthwise sidewall, a first transverse surface aligned with first transverse wall, a second transverse surface aligned with second transverse wall;

c. the interior recessed shelf is formed with four respective interior surfaces which correspond with a respective first lengthwise surface, first transverse surface, second lengthwise surface and second transverse surface;

d. adjacent the rear surfaces of interior recessed shelf is formed with an interior protruding shelf with protruding first and second lengthwise surface and first and second widthwise surfaces; and c. a decorative insert is cut away from the interior of the retainer, the decorative insert has an exterior sidewall with parallel first and second lengthwise walls and first and second parallel transverse walls with a central interior lengthwise wall and at least one interior transverse wall which divide the decorative insert into a multiplicity of separate openings through which glass is visible.

3. The method of forming garage door components in accordance with claim 2, further comprising:

a. the interior recessed shelf of the retainer is formed of sufficient thickness to pass through a garage door panel having a rear wall and interior foam of the given thickness; and b. there is further formed in the retainer a multiplicity of stiffening ribs including parallel transverse ribs respectively center positioned to support first transverse surface and first transverse wall, and second transverse surface and second transverse wall, at least one stiffening rib to support first lengthwise surface and first lengthwise sidewall, and at least one stiffening rib to support second lengthwise surface and second lengthwise sidewall.

4. A method for forming garage door components, comprising:

a forming a combination of a retainer combined with the formation of a decorative insert formed within the retainer, the decorative insert removed from the retainer to provide a separate retainer and a separate decorative insert;

b. the separate retainer includes an elevated sidewall including parallel first and second lengthwise sidewalls and parallel first and second transverse walls and an interior recessed shelf with surfaces which correspond to the walls of the elevated sidewall, including a first lengthwise surface is aligned with the first lengthwise sidewall, a second lengthwise surface is aligned with the second lengthwise sidewall, a first transverse surface aligned with first transverse wall, a second transverse surface aligned with second transverse wall;

c. the interior recessed shelf is formed of sufficient thickness to pass through a garage door panel having a rear wall and interior foam of the given thickness;

d. the interior recessed shelf is formed with four respective interior surfaces which correspond with a respective first lengthwise surface, first transverse surface, second lengthwise surface and second transverse surface; and e. a decorative insert created from the interior of the retainer, the decorative insert has an exterior sidewall with parallel first and second lengthwise walls and first and second parallel transverse walls.

5. A method in accordance with claim 4, further comprising:

vacuum forming a combination of a retainer combined with the formation of a decorative insert vacuum formed within the retainer, the decorative insert removed from the retainer to provide a separate retainer and a separate decorative insert.

6. A method in accordance with claim 4, further comprising:

there is further formed a multiplicity of stiffening ribs including parallel transverse ribs respectively center positioned to support first transverse surface and first transverse wall and second transverse surface and second transverse wall.

7. A method in accordance with claim 4, further comprising:

at least one stiffening rib to support first lengthwise surface and first lengthwise sidewall and at least one stiffening rib to support the second lengthwise surface and a second lengthwise sidewall.

8. A method in accordance with claim 4, further comprising:

adjacent the rear surfaces of interior recessed shelf is formed with an interior protruding shelf with protruding first and second lengthwise surfaces and first and second widthwise surfaces.

9. A method in accordance with claim 4, further comprising:

the decorative insert further comprises a central interior lengthwise wall which divides the decorative insert into at least two separate openings through which glass is visible.

10. A method in accordance with claim 4, further comprising:

the decorative insert further comprises at least one transverse wall which divides the decorative insert into a multiplicity of separate openings through which glass is visible.

* * * * *